US007062834B2

(12) United States Patent
Patterson et al.

(10) Patent No.: US 7,062,834 B2
(45) Date of Patent: Jun. 20, 2006

(54) PROCESS OF FORMING TWO BEADS

(75) Inventors: Christopher Patterson, Olive Branch, MS (US); Stanley J. Sysak, Cordova, TN (US)

(73) Assignee: Parker-Hannifin, Cleveland, OH (US)

( * ) Notice: Subject to any disclaimer, the term of this patent is extended or adjusted under 35 U.S.C. 154(b) by 153 days.

(21) Appl. No.: 10/725,916

(22) Filed: Dec. 1, 2003

(65) Prior Publication Data

US 2004/0128819 A1 Jul. 8, 2004

Related U.S. Application Data

(60) Provisional application No. 60/438,845, filed on Jan. 8, 2003.

(51) Int. Cl.
*B23P 11/00* (2006.01)

(52) U.S. Cl. ..... 29/505; 29/509; 29/520; 72/372; 285/331; 285/382.1; 285/382.2; 403/282; 403/285

(58) Field of Classification Search ..... 29/505, 29/506, 509, 510, 516, 520, 890.14, 890.144; 72/110, 224, 365.2, 372, 373; 285/331, 382.1, 285/382.2; 403/282, 285
See application file for complete search history.

(56) References Cited

U.S. PATENT DOCUMENTS 3,826,523 A * 7/1974 Eschbaugh ..... 285/39
3,933,378 A * 1/1976 Sandford et al. ..... 285/319
4,656,721 A * 4/1987 Werner ..... 29/523
5,387,016 A 2/1995 Joseph et al.
5,722,150 A 3/1998 Swanson, III
5,961,157 A 10/1999 Baron et al.
5,984,376 A 11/1999 Lampe
6,035,516 A * 3/2000 Petersen ..... 29/523
6,338,191 B1 * 1/2002 Petersen ..... 29/523
6,662,422 B1 * 12/2003 Pradhan ..... 29/523
6,823,575 B1 * 11/2004 Petersen ..... 29/509
6,836,951 B1 * 1/2005 Dudash et al. ..... 29/505
2002/0157235 A1 * 10/2002 Napolitano et al. ..... 29/505

* cited by examiner

*Primary Examiner*—Jermie E. Cozart
(74) *Attorney, Agent, or Firm*—Daniel J Whitman; Joseph J. Pophal

(57) ABSTRACT

A process for forming a metallic tubular connector of the type having a cylindrical shell which extends circumferentially about a tubular body for joining said tubular connector to a conduit. The process involves using a first forming machine to form a first peripheral bead in a first end portion of a tubular metallic body, having a substantially uniform diameter and wall thickness, reduce the outside diameter of a second end portion, and slope an intermediate surface portion. Then, a second end forming machine tool, carrying a metallic socket, freely receives the tubular body second end portion, contacts the sloped intermediate surface portion, forms a second peripheral bead adjacent the first peripheral bead, while an annular end surface of the socket is compressed and locked between the first and second beads. Further, the tubular body is manufactured from a 5000 series aluminum alloy material.

6 Claims, 2 Drawing Sheets

PROCESS OF FORMING TWO BEADS

CROSS-REFERENCE TO RELATED CASES

The present application claims the benefit of the filing date of U.S. Provisional Application Ser. No. 60/438,845 filed Jan. 8, 2003, the disclosure of which is incorporated herein by reference.

FIELD OF THE INVENTION

This invention is directed generally to a process of forming a tubular body of a metallic tubular connector and more particularly to attachment of a metallic socket to the tubular body during the forming process

BACKGROUND OF THE INVENTION

Tubular connectors for fluid conveying conduits are generally comprised of a tube and an attached shell and are usually manufactured from a metallic material. A conduit is coupled with the tubular connector in order to form an assembly. The conduit, usually of an elastic material, is inserted into the tubular connector such that an end of the tube is inserted into the conduit and the shell surrounds the conduit. The shell is inwardly or radially deformed so that the conduit is compressed between the tube and shell, thus retaining and sealing the combination.

Most currently available tubular connectors retain the shell component by machining a notch into the outer surface of the tube, then fitting an end of the shell into the notch. A typical example of this type of design is shown in a prior art construction, such as U.S. Pat. No. 5,984,376 to Lampe. A disadvantage with this type of design is that the machined notch can damage the tube thus creating an area prone to fatigue failure.

Another method of forming an attachment of the conduit to the tubular connector is shown in U.S. Pat. No. 5,722,150 to Swanson, III. This method uses a pair of bead lock rings with an expandable ring compressed therebetween. The shell is then advanced over the ring and inwardly crimped. The novel process of the present invention differs from this method by compressing the shell between two formed beads and avoids adding a further component, the expandable ring.

Another method of attaching the shell to the tube is shown in U.S. Pat. No. 5,961,157 to Baron et al. An embodiment of this method shows the shell compressed between two beads formed in the tube. The tube is separate from the nipple, unlike the present design, and also adds a further component to the connector.

Still another tubular connector using a bead to attach the shell to the tube is shown in U.S. Pat. No. 5,387,016 to Joseph et al. In this design, the shell is compressed between a formed bead and a shoulder of the tube. The method of forming the bead differs from that of the present invention in that stress is applied to the end of the nipple to form the bead.

Up to this time, typical uses of 5000 series aluminum alloys have been restricted to primarily shell metal applications. Due to its excellent corrosion resistance and overall strength, it is a desirable substitute same for the commonly used 3000 series aluminum alloys. But due to its hardness, the 5000 series is difficult to machine and is difficult to roll-form without damaging same. Therefore, most roll-formed methods employ the 3000 series alloys since they are soft and easy to form even though they lack the noted attributes of the 5000 series alloys.

SUMMARY OF THE INVENTION

The present invention provides a process for roll-forming a tube element of a tubular connector made from 5000 series aluminum. The process forms two beads on the tubular element and affixes a metallic socket therebetween.

More specifically, the present invention has provided a process for forming a metallic tubular connector of the type having a cylindrical shell which extends circumferentially about a tubular body for joining said tubular connector to a conduit involving the first step of gripping a first end portion of a tubular metallic body, having a substantially uniform diameter and wall thickness, in a first forming machine that utilizes a first forming tool for contact with the tubular body. The outside diameter of a second end portion of the tubular body is reduced and an intermediate surface portion, which joins the uniform diameter first end portion and the reduced diameter second end portion, is sloped. A first peripheral bead is formed in the first end portion of the tubular body. Next the tubular body first end portion on the portion thereof not adjoining the intermediate surface portion is gripped by a second forming machine that utilizes a second forming tool for contact with the tubular body intermediate surface portion. The second tool carries a metallic socket on a first end portion thereof and has a longitudinal, central, axial passage extending from the first end portion for an axial length exceeding the diameter and at least the axial length of the tubular body reduced diameter second end portion. The second forming tool is then axially advanced toward the tubular body such that the tubular body second end portion is freely received within the longitudinal passage and the second tool first end contacts the sloped intermediate surface portion and forms a second peripheral bead adjacent the first peripheral bead. At the same time an annular end surface of the socket is compressed and locked between the first and second beads. A feature of this noted process has the tubular body being manufactured from a 5000 series aluminum alloy material.

A further feature of the noted process has the forming tools being punches. Another feature includes having the combined axial extent of the two beads being at least four times the wall thickness of the tubular body, prior to undergoing the forming process. Still, another feature of the noted process has the tubular body reduced diameter second end remaining free of contact with any portion of the second forming tool while inside the passage therewithin.

Another feature of the noted process, after the first bead forming step, has the first bead including a predetermined gap at about the center of its axial extent. Still yet another feature has the predetermined gap, in the first bead, acting as a buffer and providing room for additional compression of the first bead during the forming step of the second bead. Further features and advantages of the present invention will become apparent to those skilled in the art upon review of the following specification in conjunction with the accompanying drawings.

DETAILED DESCRIPTION OF THE PREFERRED EMBODIMENT

Figure 1:
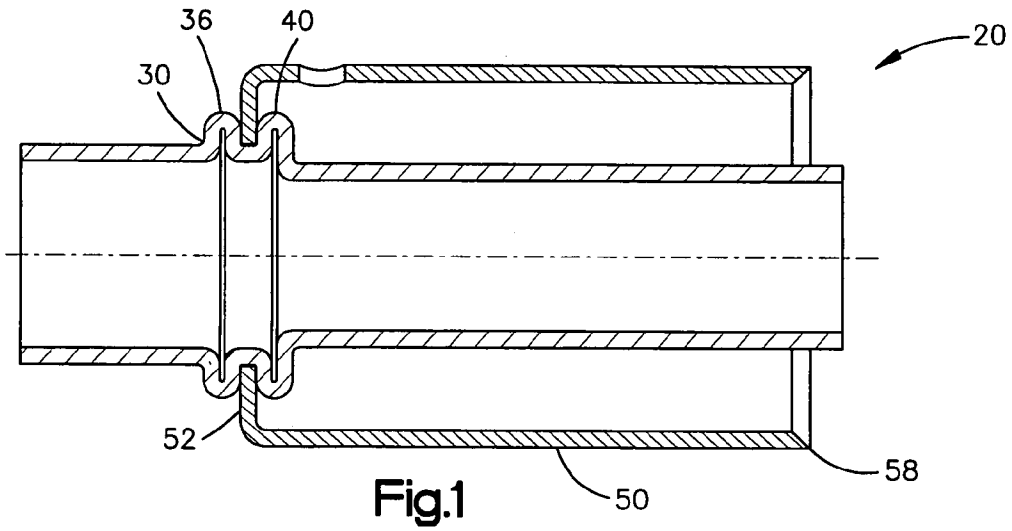
FIG. 1 is a longitudinal cross-sectional view of a two bead tubular connector embodying a product produced by the method of the present invention.

Referring to the drawings and particularly to FIG. 1, a tubular connector 20 according to the present invention is shown. Tubular connector 20 is comprised of a tube 30 and an attached shell 50. Shell 50 is affixed to tube 30 by being compressed between an initially-formed first bead 36 and a subsequently-formed second bead 40.

Figure 2:
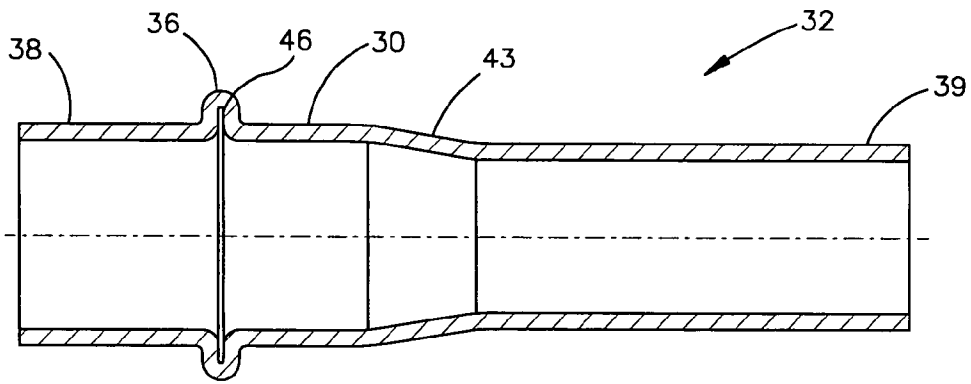
FIG. 2 is a longitudinal cross-sectional view of a tube portion of the tubular connector, at an intermittent stage of the process of the present invention, after the forming of the first bead.

The process of roll-forming first bead 36, second bead 40 and affixing shell 50 therebetween begins with a straight cylindrical tube of substantially uniform diameter and wall thickness (not shown). As is well known in the roll-forming art, the straight tube is gripped into a set of jaws or blocks in an endform machine, for example—a Manchester Endformer, in order to form a single bead tube 32, as shown in FIG. 2. Specifically, a punch on the endformer moves forward and swages, or reduces, the outside diameter of the straight tube from that shown at tube first end portion 38 down to that shown at tube second end portion 39. A sloped intermediate portion 43, located between first end portion 38 and second end portion 39, is also swaged, and has a gradient of approximately 15°. Simultaneously, first peripheral bead 36 is formed in first end portion 39 and has an axial width greater than twice the wall thickness of tube 30 due to a gap 46 at about the center of the axial extent of first bead 36. Without gap 46, the width or axial extent of first bead 36 is decreased to about twice (or less) of the tube initial wall thickness which may tend to crack bead 36, thus providing a possible failure mode via fatigue.

Figure 3:
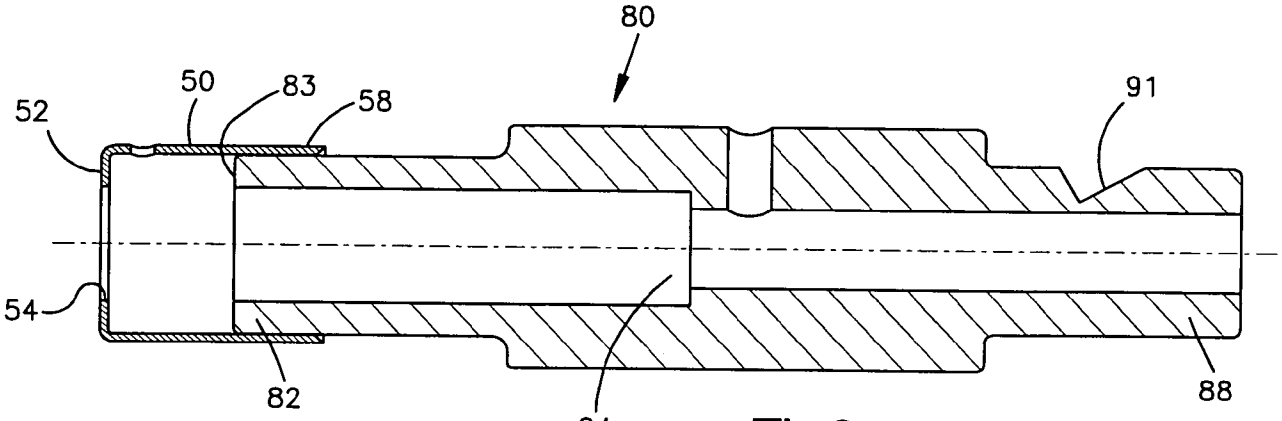
FIG. 3 is a longitudinal cross-sectional view of a forming punch-tool, with a socket or shell portion of the tubular connector being carried on one end of the tool.

After forming single bead tube 32 as shown in FIG. 2, it is removed from the first endformer and gripped in a second endform machine (not shown) at first end portion 38 by a set of jaws or blocks. As shown in FIG. 3, a punch 80, attached to the endformer, is used for the next formation step. Punch 80 has a front end portion 82, a rear end portion 88, and a passage 94 longitudinally extending from front end portion 82 to rear end portion 88. The endforming machine retains punch 80 at a notch 91, formed in punch rear end portion 88. Shell 50 is slidably retained or carried at its inside diameter on the outer diameter of punch front end portion 82 during each cycle so that it can be positioned on tube 30 prior to the formation of second bead 40. Referring to FIGS. 2 and 3, and assuming the longitudinal centerline thereof to be coaxial, punch front end portion 82 approaches single bead tube 32 (gripped at first end portion 38 by the set of blocks in a second endform machine) and passes through a circular opening 54 at shell first end 52, so that tube second end portion 93 is received within punch passage 94. Punch 80 continues to move longitudinally until an annular front edge surface 83, of front end portion 82, comes in contact with and physically displaces sloped tube portion 43 toward previously-formed first bead 36. Moving with punch front end portion 82, shell first end 52 travels axially past tube second end 39 and over sloped portion 43, until it abuts one side of first bead 36. The force exerted by moving punch 80 roll-forms second bead 40 (shown in FIG. 4) as punch 80 completes its stroke, with shell first end 52 being compressed and locked between previously-formed first bead 36 and newly-formed second bead 40.

Figure 4:
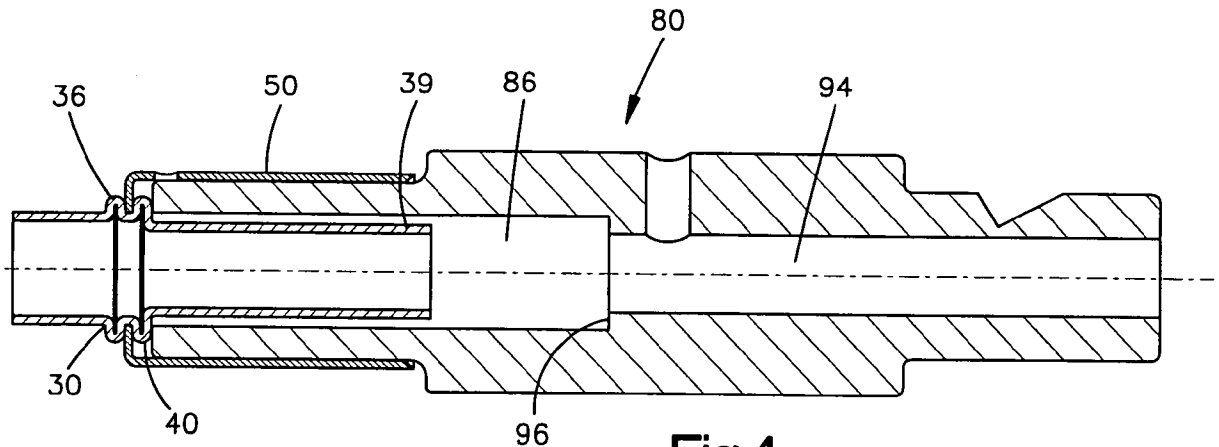
FIG. 4 is a longitudinal cross-sectional view of the forming punch-tool of FIG. 3 at the end of the process steps that form the second bead and lock the socket between the first and second beads.

The forming of second bead 40 is commenced by the contact of punch 80 with sloped tube portion 43. The desired material for tube 30 is a 5000 series aluminum alloy, which due to its hardness does not have favorable roll-forming properties. Referring to FIG. 4, during the forming process, if tube second end 39 were to come into contact with any portion of punch 80, the force transferred to beads 36 and 40 would cause an internal fracture of either bead. Therefore, at the end of the punch stroke, an axial gap 86 still exists between tube second end portion 39 and a shoulder 96 formed within punch passage 94, thus eliminating the possibility of any additional force being transferred to tube 30.

As discussed above and shown in FIG. 2, a gap 46 exists at about the center of the axial extent of first bead 36. Gap 46 acts as a shock buffer and provides room for further compression of first bead 36. Without gap 46 in bead 36, the formation of second bead 40 would cause first bead 36 to crack since the formation of second bead 40 causes first bead 36 to compress even more than during its initial formation. Therefore, the final combined width or axial extent of first and second beads 36, 40 should be greater than or equal to four times the wall thickness of the original tube. Any smaller width would tend to cause the fracture of one or both beads due to the properties of the 5000 series aluminum alloys being used.

Other forms of shell attachment to the tube include having a notch cut or formed into the tube outer surface in order to receive the shell. Machining a notch into the tube can damage the tube and provide a weak area that may fracture if sufficient stress is applied to the tube. For example, if tube second end 39 were to come in contact with shoulder 96 of punch 80 during the forming process, a notch, or any other machined indentation within the surface of tube 30 could fracture due to the stress as involved. The present design and forming process deletes the notch and prevents tube second end portion 39 from contacting punch 80 during the forming process. By eliminating any contact between tube second end portion 39 and punch 80, any details or shapes machined or roll-formed into tube 30 remain undisturbed and in their original state during the forming process. This is important for details/shapes such as O-ring grooves that require controlled profiles for receiving O-rings or the like.

It should be noted that the present invention is not limited to the specified preferred embodiments and principles. Those skilled in the art to which this invention pertains may formulate modifications and alterations to the present invention. These changes, which rely upon the teachings by which this disclosure has advanced, are properly considered within the scope of this invention as defined by the appended claims.

What is claimed is:

1. A process for forming a metallic tubular connector of the type having a cylindrical shell which extends circumferentially about a tubular body for joining said tubular connector to a conduit, comprising the steps of:

i. gripping a first end portion of a tubular metallic body, having a substantially uniform diameter and wall thickness, in a first forming machine that utilizes a first forming tool for contact with said tubular body;

ii. reducing the outside diameter of a second end portion of said tubular body and sloping an intermediate surface portion joining said uniform diameter first end portion and said reduced diameter second end portion;

iii. forming a first peripheral bead in the tubular body in said first end portion;

iv. gripping said tubular body first end portion on the portion thereof not adjoining said intermediate surface portion in a second forming machine that utilizes a second forming tool for contact with said tubular body intermediate surface portion, said second tool carrying a metallic socket on a first end portion thereof and having a longitudinal, central, axial passage extending from said first end portion for an axial length exceeding the diameter and at least the axial length of said tubular body reduced diameter second end portion;

v. axially advancing said second forming tool toward said tubular body such that said tubular body second end portion is freely received within said longitudinal passage, said second tool first end contacting said sloped intermediate surface portion and forming a second peripheral bead adjacent said first peripheral bead; and vi. compressing and locking an annular end surface of said socket between said first and second beads.

2. The process as in claim 1 wherein said forming tools are punches.

3. The process as in claim 1 wherein said two beads have a combined axial extent of at least four times the wall thickness of said tubular body, prior to undergoing the forming process.

4. The process as in claim 1 wherein said tubular body is manufactured from a 5000 series aluminum alloy material.

5. The process as in claim 1 wherein after said first bead forming step, said first bead includes a predetermined gap at about the center of its axial extent.

6. The process as in claim 5 wherein said predetermined gap, in said first bead, acts as a buffer and provides room for additional compression of said first bead during the forming step for said second bead.

* * * * *